US007231980B2

(12) United States Patent
Murray et al.

(10) Patent No.: US 7,231,980 B2
(45) Date of Patent: Jun. 19, 2007

(54) SELF ORIENTING LATERAL JUNCTION SYSTEM

(75) Inventors: Douglas J. Murray, Humble, TX (US); David J. Westgard, Cypress, TX (US); Aubrey C. Mills, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/878,795

(22) Filed: Jun. 28, 2004

(65) Prior Publication Data

US 2005/0006100 A1 Jan. 13, 2005

Related U.S. Application Data

(60) Provisional application No. 60/484,601, filed on Jul. 2, 2003.

(51) Int. Cl.
*E21B 7/06* (2006.01)

(52) U.S. Cl. ..... 166/313; 166/50; 166/117.6

(58) Field of Classification Search ..... 166/313, 166/50, 117.5, 117.6
See application file for complete search history.

(56) References Cited

U.S. PATENT DOCUMENTS 2,312,805 A * 3/1943 Douglas ..... 166/100
2,691,507 A * 10/1954 Brown ..... 166/117.5
5,477,925 A * 12/1995 Trahan et al. ..... 166/382
5,918,690 A * 7/1999 Hailey ..... 175/298
5,944,108 A 8/1999 Baugh et al.
6,209,648 B1 4/2001 Ohmer et al.
6,315,054 B1 11/2001 Brunet
6,547,006 B1 * 4/2003 Kuck et al. ..... 166/298
6,848,504 B2 * 2/2005 Brunet et al. ..... 166/117.5
2002/0000319 A1 1/2002 Brunet

OTHER PUBLICATIONS

PCT International Search Report, dated Oct. 21, 2004.

* cited by examiner

*Primary Examiner*—Kenneth Thompson
(74) *Attorney, Agent, or Firm*—Cantor Colburn LLP

(57) ABSTRACT

A self orienting liner hanger system including a bent sub, an indexing sub in operable communication with the bent sub, a hanger assembly in operable communication with the indexing sub, and a profile connected with the hanger assembly.

Yet further disclosed herein is a method for constructing a junction between a primary borehole and a lateral borehole. The method includes installing a window sleeve at the junction, running a liner hanger into the sleeve, cycling an indexing sub of the hanger until a bent sub of the hanger exits the window, and running the hanger into engagement with the sleeve.

10 Claims, 6 Drawing Sheets

SELF ORIENTING LATERAL JUNCTION SYSTEM

CROSS-REFERENCE TO RELATED APPLICATIONS

This application claims the benefit of an earlier filing date from U.S. Provisional Application Ser. No. 60/484,601 filed Jul. 2, 2003, the entire contents of which is incorporated herein by reference.

BACKGROUND

Hydrocarbon exploration and production wells require boreholes into the earth. With traditional single bore wells many structures were needed at the surface to service the well (derek, etc.) More recently multilateral wellbores have become popular since they reduce the surface impact and are more economically favorable to operate. In many multilateral junctions it is desirable to have a junction system in place. These are often run in on a work string to be placed correctly.

Lateral junction systems, and particularly the hook hanger liner system commercially available from Baker Oil Tools, Houston, Tex. and commonly known as the hook hanger, is an oft-used junction system in multilateral wellbores. The system provides a great many benefits to the art and works very well when run on rotatable tubing. Providing that alignment of the bent sub of the system is within about ±60° to 90° of the casing exit window, the system will exit the window and the liner and the hook hanger will continue to advance. Where the bent sub is outside of the about ±60° to 90° from alignment with the casing exit window, the bent sub will pass down the primary borehole, usually to a restriction. In this event, the system is pulled back, rotated from the surface and advanced again. This process is repeated until the bent sub exits the target window. Later in the operation, as the hook hanger itself draws near the window, the hook of the hook hanger must be aligned within about ±30° of the exit window so that it will self align at the bottom vee of the window. If the hook is not aligned within about ±30° of the window then the hook will not self align and it is necessary to pull the system back uphole until the hook is above the level of the lateral and rotate the string for another try. As is well known commercially, the system works very well for its intended purpose when run on rotatable tubing. Unfortunately, however, a drawback of the system becomes apparent when it is desired or required to run coil tubing instead of a standard work string. The drawback is experienced because of an inherent issue of coil tubing. Coil tubing cannot be rotated. It is therefore not possible to reposition a hook hanger product that does not by luck hit the exit window on the first pass. Heretofore, then, it has simply been impractical to attempt a use of a hook hanger product where coil tubing is the venue.

SUMMARY

The drawbacks of the prior art system are overcome by the system and method as taught herein. Disclosed herein is a self orienting liner hanger system including a bent sub, an indexing sub in operable communication with the bent sub, a hanger assembly in operable communication with the indexing sub, and a profile connected with the hanger assembly.

Further disclosed herein is a self orienting junction system for completing a junction between a primary borehole and a lateral borehole. The system includes a window sleeve installable in the primary borehole and a liner hanger installable through the window sleeve and having a bent joint and an indexing sub, capable of rotating the bent sub a number of degrees.

Yet further disclosed herein is a method for constructing a junction between a primary borehole and a lateral borehole. The method includes installing a window sleeve at the junction, running a liner hanger into the sleeve, cycling an indexing sub of the hanger until a bent sub of the hanger exits the window, and running the hanger into engagement with the sleeve.

BRIEF DESCRIPTION OF THE DRAWINGS

Referring to the drawings wherein like elements are numbered alike in the several Figures.

DETAILED DESCRIPTION

A solution to the impossibility of running hook hanger products on coil tubing is an assemblage of components that overcome the problem and retain the benefits of the current hook hanger products. It should be noted that the assemblage discussed hereunder is not limited to use with coil tubing but rather can be used on any type of work string.

Figure 1:
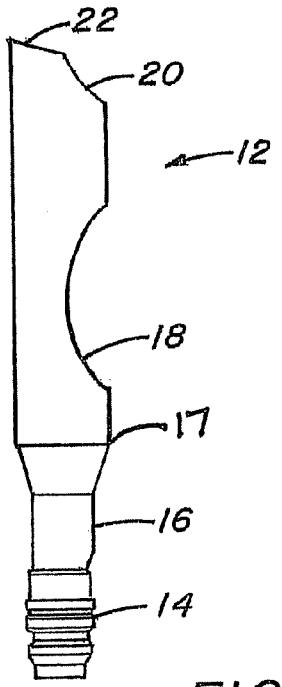
FIG. 1 is a schematic representation of the window sleeve component of the system prior to running.

Referring to FIG. 1, the assemblage of components making up the self orienting lateral junction system prior to running are illustrated. A window sleeve 12 is illustrated having a landing configuration 14 (which positions, locates and orientates the window sleeve 12), a tail pipe 16, a premachined window 18 and a helical profile 20/22 at an uphole end of the sleeve.

There are many devices (illustrated and discussed further hereunder) currently available to locate and orientate configuration 14 such as the TorqueMaster Packer™, the MLZX™ liner hanger, the multilateral point reference, etc., all commercially available from Baker Oil Tools, Houston, Tex.

Window sleeve 12 includes a helical profile 20/22, which is uphole facing and which is the aligning device for ensuring that the window on the liner hanger (discussed hereunder) is properly aligned with the axial bore of the window sleeve and the primary bore in which the system is installed.

Figure 2:
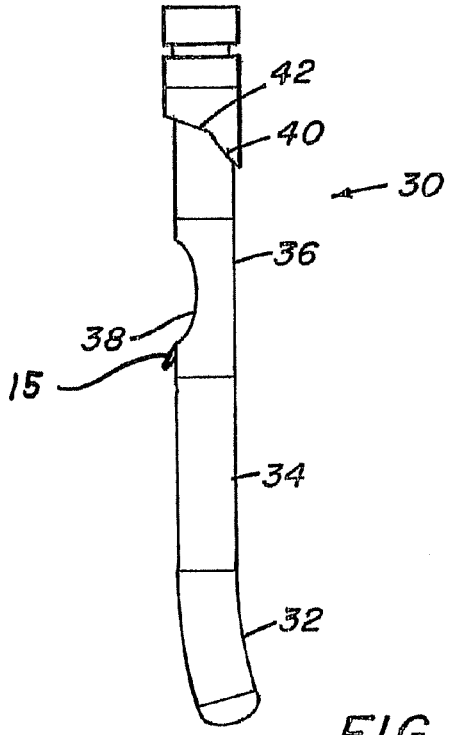
FIG. 2 is a schematic illustration of a hook liner hanger.

Referring to FIG. 2, a hook hanger liner hanger 30 is illustrated. The hanger 30 in FIG. 2 is positioned relative to FIG. 1 to show orientation prior to engagement. At a downhole end of hanger 30 is a bent sub 32. Bent sub 32 is attached at its uphole end to a biased indexing sub 34. Bias may be effected by any number of different means such as spring, gas pressure, electrical, apparatus, etc. Indexing sub 34 has as its function to rotate the bent sub 32 a selected number of degrees of rotation if weight is applied thereto, which will happen if the bent sub misses the lateral and encounters a restriction in the primary bore (which is designed in). As the bent sub is picked back up above the lateral the rotation will occur automatically without any rotation from the surface. As was stated earlier, such surface rotation on coil tubing is impossible. In one embodiment the rotation occurs through 60 degrees while in another embodiment the rotation occurs through 120 degrees. It should be noted that any number of degrees of rotation can be selected at the design/build phase of the sub. The indexing sub functions identically as does a ratcheting mule shoe which is commercially available from many sources.

Uphole of indexing sub 34 is hook hanger 36 which is similar to a commercially available hook hanger but does not necessarily include the hook to mount in the bottom vee 17 of the window 18 (and casing exit window which is not visible in this drawing). The helical profile orients and hangs the liner hanger. It will be understood that a hook as conventional could also be employed. A hook hanger 15 includes a premachined opening 38 which is to be aligned with the primary bore after a lower portion of system 30 has exited the window 18. Opening 38 provides for re-entry to the primary bore below the lateral, usually after completion of the lateral.

At the uphole end of a hook hanger 30 is a profile 40/42 which in one embodiment is a compound profile designed and orientated to engage with the profile 20/22. The profiles interengage to assist in orienting the hook hanger properly to be secure with respect to the window exiting to the lateral and to align the opening 38 with the primary bore as well as to hang the liner hanger.

Referring now to FIGS. 3–7, a sequence of drawings is provided which illustrate a wellbore at a lateral junction at various stages of completion and which is completed according to a method and with a system as described herein.

Figure 3:
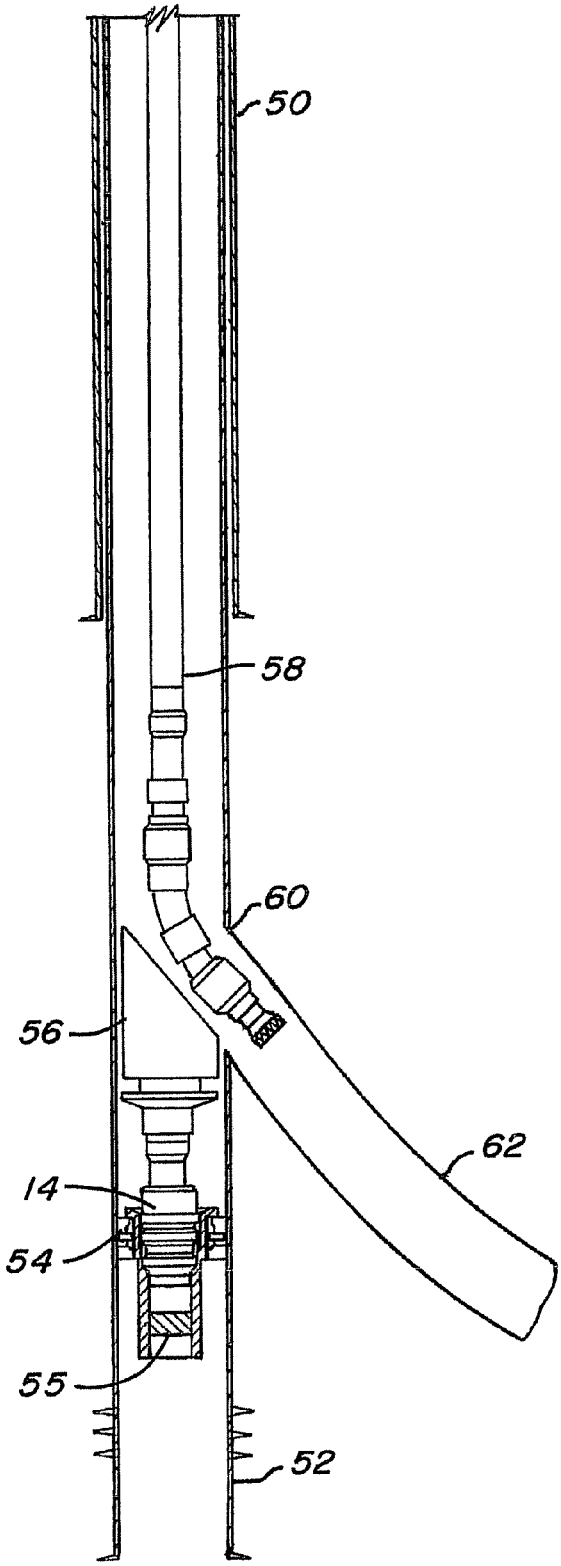
FIG. 3 is a first of a sequence of drawings illustrating a method for installing a junction.

FIG. 3 illustrates a primary borehole 50 with a casing string 52. A torque master multilateral packer 54 is depicted installed in primary casing 52 and includes a plug 55 to prevent debris from entering the primary bore below the packer. A whipstock 56 of some kind (a monobore whipstock system depicted from Baker Oil Tools) is installed in the packer or anchor 54 and a drill string 58 is run to cut a casing window 60 and drill a lateral bore 62 at least partially.

Figure 4:
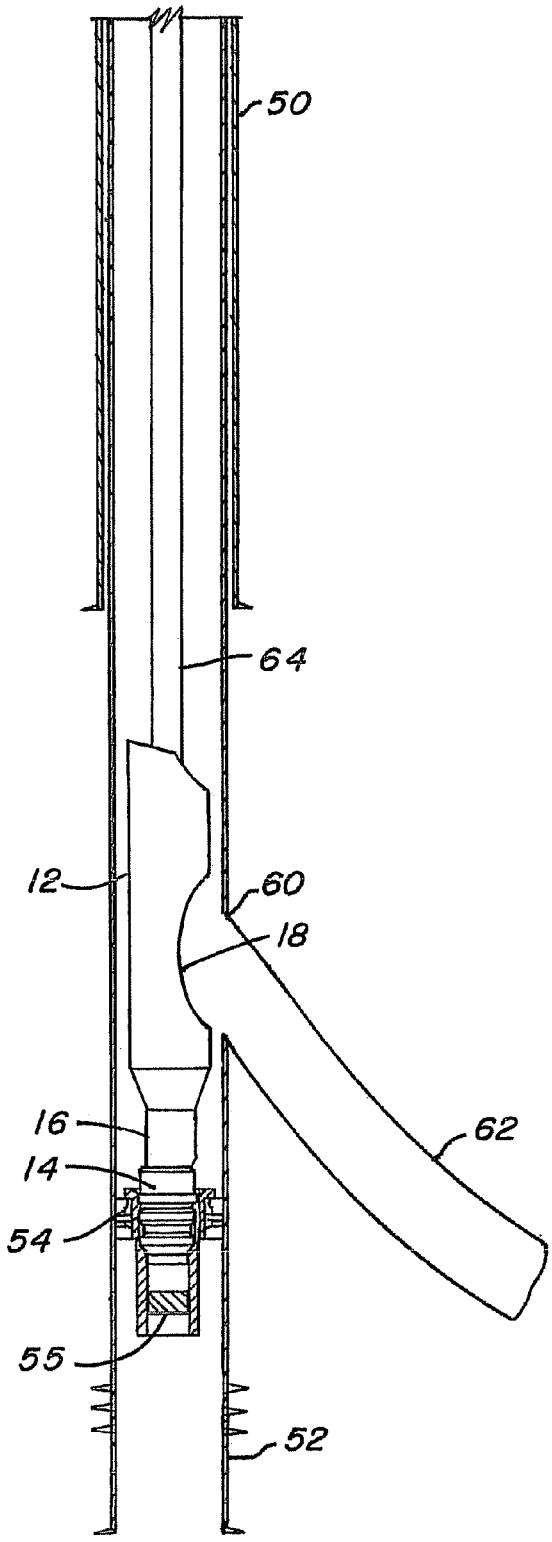
FIG. 4 is a second of a sequence of drawings illustrating a method for installing a junction.

Moving to FIG. 4, the drill string 58 has been removed and a work string 64 is run with window sleeve 12 mounted thereon for installation in packer/anchor 54. As noted previously, the sleeve 12 includes configurations that ensure that when it is engaged with packer/anchor 54, it will orientate correctly to align window 18 with casing exit 60. The work string 64 is then removed form the bore.

Figure 5:
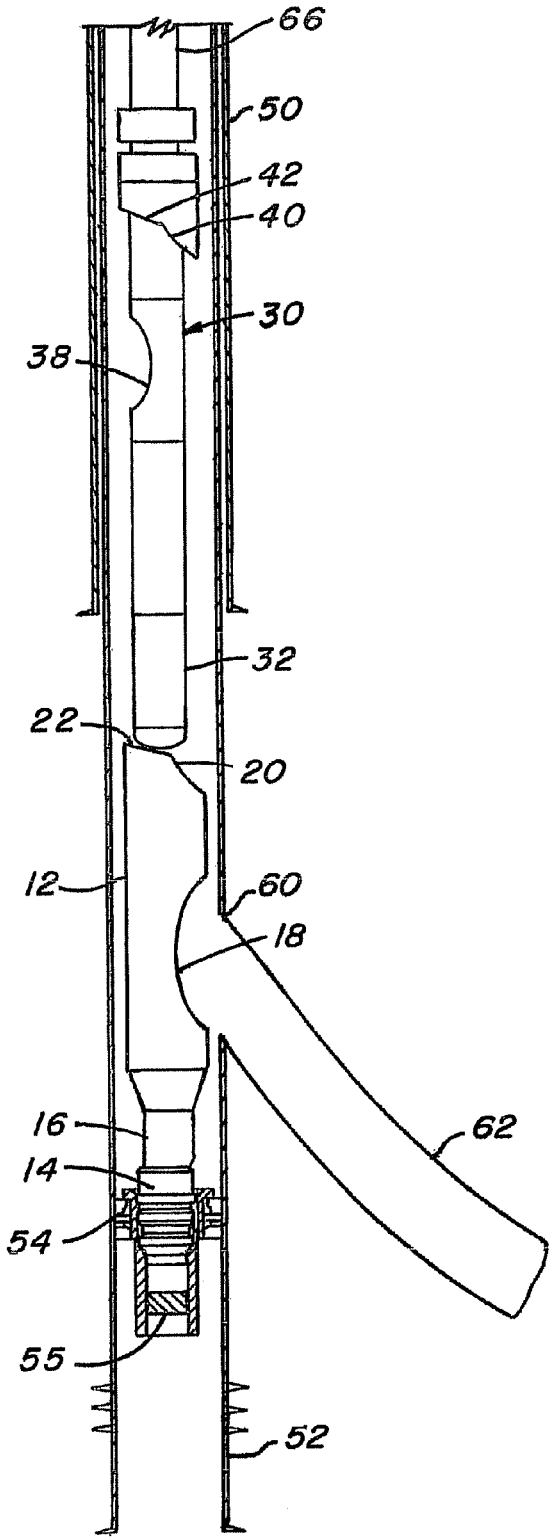
FIG. 5 is a third of a sequence of drawings illustrating a method for installing a junction.

Next, referring to FIG. 5, another work string 66, which may be a coil tubing, is employed to run in the hook hanger system 30 as described above. In the event the bent sub 32 is in position to exit the primary casing 52, it will do so as it advances. In the event the bent sub does not happen to be aligned with casing exit 60, the sub 32 will enter a restriction in tailpipe 16 where the biased indexing sub 34 will cycle to rotate the bent sub 32 by a set number of degrees. As the bent sub is picked up above the window the indexing sub 34 initiates the rotation. This action is continued until the bent sub 32 exits the casing exit 60 and is therefore able to proceed into the lateral.

Figure 6:
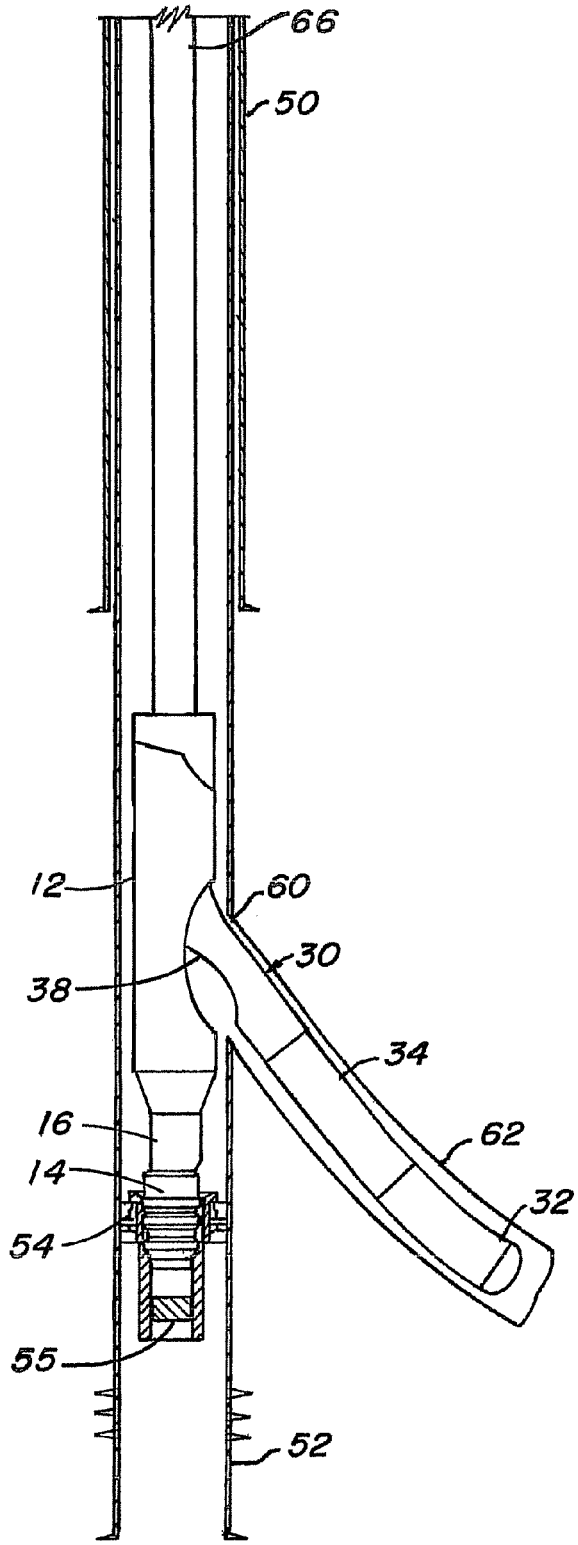
FIG. 6 is a forth of a sequence of drawings illustrating a method for installing a junction.

Referring to FIGS. 5 and 6, and with particular focus on the compound profiles 20/22 and 40/42, the pre and post engagement positions are shown. Where hook hanger 30 is aligned sufficiently for bent sub 32 to exit window 60 but not sufficiently to be properly engaged, the profiles will complete the alignment to ensure the hanger 30 is positioned and orientated as intended.

Figure 7:
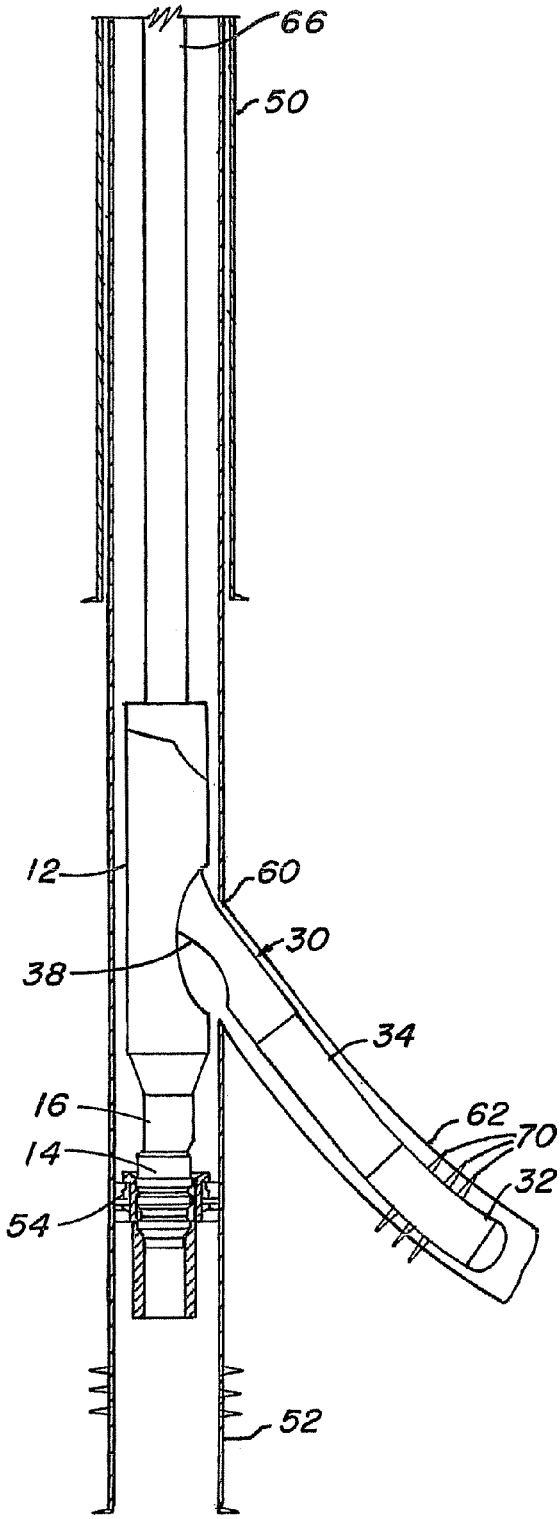
FIG. 7 is a fifth of a sequence of drawings illustrating a method for installing a junction.

FIG. 7 illustrates the further completed lateral with perforations 70 and with access to the primary bore below the packer 54 restored by removal of plug 55. Plug 55 may be removed mechanically by drilling, chemically, etc.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A self orienting liner hanger system comprising:
- a bent sub;
- an indexing sub in operable communication with the bent sub, the indexing sub itself causing rotational movement of the bent sub a number of degrees upon cycling of weight thereon;
- a hanger assembly in operable communication with the indexing sub; and
- a profile connected with said hanger assembly.

2. A self orienting liner hanger system as claimed in claim 1 wherein said system further includes a premachined window sleeve having a profile at an uphole end thereof complementary to said profile connected with said hanger assembly.

3. A self orienting liner hanger system as claimed in claim 1 wherein said indexing sub rotates said bent sub upon a weight removal portion of the cycling of weight.

4. A self orienting liner hanger system as claimed in claim 1 wherein said hanger assembly includes a hook landable in a window vee.

5. A self orienting junction system for completing a junction between a primary borehole and a lateral borehole comprising:
- a window sleeve installable in the primary borehole; and
- a liner hanger installable through the window sleeve and having a bent joint and an indexing sub, the indexing sub causing rotation of the bent sub a number of degrees upon cycling of weight on the indexing sub.

6. A junction comprising:
- a primary borehole;
- a lateral borehole extending from the primary borehole;
- a window sleeve installed in the primary borehole and having a profile on an uphole end; and
  - a liner hanger including
    - a bent sub;
    - an indexing sub in operable communication with the bent sub, the indexing sub itself causing rotational movement of the bent sub a number of degrees upon cycling of weight thereon;
    - a hanger assembly in operable communication with the indexing sub: and
    - a profile connected with said hanger assembly extending through the window sleeve.

7. A method for constructing a junction between a primary borehole and a lateral borehole comprising:
- installing a window sleeve at the junction;
- running a liner hanger into said sleeve;
- cycling weight on an indexing sub of said hanger causing the indexing sub itself to rotate a bent sub a number of degrees from each cycle until the bent sub of said hanger exits said window; and
- running said hanger into engagement with said sleeve.

8. A method for constructing a junction between a primary borehole and a lateral borehole as claimed in claim 7 wherein said method further includes accessing the primary borehole downhole of the sleeve.

9. A method for constructing a junction between a primary borehole and a lateral borehole as claimed in claim 7 wherein said running said liner hanger is on coil tubing.

10. A method for constructing a junction between a primary borehole and a lateral borehole as claimed in claim 7 wherein said cycling causes rotating of said bent upon a weight removal portion of the cycling of weight.

* * * * *